US006935281B2

(12) United States Patent
Ruegg

(10) Patent No.: US 6,935,281 B2
(45) Date of Patent: Aug. 30, 2005

(54) METHOD FOR CLEANING COMBUSTION DEVICES

(75) Inventor: Hans Ruegg, Wohlen (CH)

(73) Assignee: Bang & Clean GmbH, Wohlen (CH)

( * ) Notice: Subject to any disclaimer, the term of this patent is extended or adjusted under 35 U.S.C. 154(b) by 177 days.

(21) Appl. No.: 10/474,576

(22) PCT Filed: Mar. 25, 2002

(86) PCT No.: PCT/CH02/00174

§ 371 (c)(1),
(2), (4) Date: Nov. 13, 2003

(87) PCT Pub. No.: WO02/084193

PCT Pub. Date: Oct. 24, 2002

(65) Prior Publication Data

US 2004/0112306 A1 Jun. 17, 2004

(30) Foreign Application Priority Data

Apr. 12, 2001 (CH) ..... 700/01
Jan. 30, 2002 (CH) ..... 154/02

(51) Int. Cl.[7] ..... F22B 37/18
(52) U.S. Cl. ..... 122/379; 165/84
(58) Field of Search ..... 122/379, 395, 122/24; 165/84; 102/302, 312, 313

(56) References Cited

U.S. PATENT DOCUMENTS 4,640,043 A 2/1987 Sigler
4,905,900 A * 3/1990 Scharton et al. ..... 239/99
5,769,034 A * 6/1998 Zilka et al. ..... 122/379
6,431,073 B1 * 8/2002 Zilka et al. ..... 102/302

FOREIGN PATENT DOCUMENTS

EP 1 067 349 A2 1/2001

OTHER PUBLICATIONS

Patent Abstracts of Japan, Publication No.: 60009593, Publication Date: Jan. 18, 1985, Method and Device for Cleaning Welding Chip.
WO 99/24177, Publication Date: May 20, 1999, Method and Apparatus for Cleaning Molds Used in the Glass Fabrication Industry.

* cited by examiner

*Primary Examiner*—Gregory Wilson
(74) *Attorney, Agent, or Firm*—Rankin, Hill, Porter & Clark LLP

(57) ABSTRACT

An on-line method and a device for cleaning of contamination such as caking or slag deposits from surfaces in vessels and combustion installations by means of blasting technology. An explosive gas mixture is made to detonate in the proximity of the deposits and thereby clean the deposits from the surfaces.

18 Claims, 3 Drawing Sheets

METHOD FOR CLEANING COMBUSTION DEVICES

BACKGROUND OF THE INVENTION

1. Field of the Invention

The invention generally relates to a method and device for cleaning vessels contaminated with dirt, such as slag or ashes, and, more particularly, toward a method and device for the on-line blast cleaning of combustion installations.

2. Description of Related Art

Heating surfaces in waste incineration plants and coal-fired boilers are subject to contamination with dirt. The dirt normally has inorganic compositions and is typically produced by deposits of ash particles on the walls. Areas in the zone of high flue gas temperatures are in most instances very hard because they remain stuck to the walls either in molten form, or melted on form, or else are stuck together on the wall by substances melting or condensing at lower temperatures, when these solidify on the colder boiler wall. Coatings of this kind can only be removed with difficulty and unsatisfactorily by known cleaning methods. This leads to the consequence that the boiler has to be switched off periodically, cooled down, and cleaned either manually or by means of sandblasting. Because boilers of this kind ordinarily have very large dimensions, it is frequently necessary to install scaffolding in the furnace for this purpose. This also requires an interruption of the operation lasting several days or weeks and apart from this, because of the substantial dust and dirt emissions it is exceedingly unpleasant and unhealthy for the cleaning personnel. A usually unavoidable accompanying phenomenon of the interrupted operation of an installation is damage to the vessel materials themselves as a consequence of the great temperature changes. Apart from the cleaning and repair costs, the stand-still costs or lost income from the installation due to the production represent an important overall cost factor.

Conventional cleaning methods, for example, are boiler beating and the utilisation of steam-jet cleaners, water-jet blowers/soot blowers and shot peening.

Known is a cleaning method in which the cooled down -and also the hot boiler still in operation is cleaned by means of the introduction and igniting of explosive devices. In the case of the method described in the document EP 1 067 349, a cooled explosive device by means of a cooled lance is brought into the proximity of the heating surface contaminated with dirt, where the explosive device is then ignited. The cakings on the heating surfaces are blasted off by force of the detonation, as well as by the vibrations of the wall produced by the shock waves. With this method, the cleaning time in comparison with the conventional cleaning methods is reduced significantly. With the necessary safety precautions, the cleaning can take place on-line, i.e., during the operation of the combustion furnace and while the vessel is still in a hot condition. With this method, the boiler may be cleaned in a matter of hours, while the conventional cleaning method would require days.

Disadvantageous in the case of the method described in EP 1 067 349 is the necessity of explosives. Apart from the high costs of the explosive material, in order to avoid accidents, for example, during the storage of the explosive material, elaborate security precautions have to be undertaken. The introduction of explosive material into a hot vessel in addition calls for an absolutely reliable and efficient cooling system, in order to prevent a premature detonation of the explosive material.

SUMMARY OF THE INVENTION

The present invention is directed toward creating a method and device for cleaning of combustion installations or vessels contaminated with dirt and slag wherein the installation does not have to be shutdown during the cleaning operation. The present invention is further directed toward a method and device wherein the installation is in a clean condition again in a short time, and in which any endangering of personnel and of installation components during the cleaning process is minimised.

The cleaning method disclosed here is based on bringing gaseous, liquid and/or powdery materials or components, which are either individually explosive or in preferably only explosive as a mixture, into proximity of an object to be cleaned, in order to subsequently get the at least partially gaseous explosive mixture to detonate.

For the protection of people, the materials should be able to be stored and handled separately in order to, if at all possible, be able to exclude the hazard of a premature explosion. This is possible with the cleaning method in accordance with the invention, because the explosive material or the explosive mixture is capable of being produced at the point or in the vicinity of the point of a vessel, in which it is to be utilised. This enhances the safety for persons and objects. With the cleaning device according to the invention, during an introduction and positioning process of the device no explosive materials or components are present yet and, therefore are not exposed to the prevailing heat.

The cleaning process in accordance with the invention is particularly suitable for combustion installations with sticky, fly ash with a tendency to caking, which is produced especially by the combustion of coal, refuse, sewage sludge or hazardous waste materials. This is applicable in particular in the field of steam generators of combustion installations. The cleaning process, however, may also be applied for the removal of dirt in other installations with hard deposits of dirt such as, for example, in flue gas cleaning installations, paper mills, silos, in the cement industry, etc. The blast cleaning is able to be carried out during the operation of a plant, i.e., on-line or with the vessels still hot and exceedingly purposefully and precisely dosed. As a result, the plant downtime costs are reduced and no components of the installation or sections of the vessel are unnecessarily subjected to any load. The hazards for the personnel of the plant are also minimised. This, in particular, results from the exceedingly short dwell time of the at least partially gaseous explosive components or of the mixture in the hot ambient.

In a preferred embodiment of the cleaning method according to the invention, a fuel in liquid or gaseous form, such as acetylene, ethylene, methane, ethane, propane, petrol (gasoline), oil, etc., and an oxidising agent such as oxygen, are brought into proximity with a surface to be cleaned. There the components are mixed together and subsequently ignited. The force of the detonation and the surface made to vibrate by the shock waves, e.g. a wall of a vessel or of a pipe, cause the breaking off of the cakings on the walls and with this the cleaning of the surface. The components can also be mixed together in the device according to the invention.

The force of the explosion necessary for cleaning and, with this, the quantity of the materials used is dependent on the type of contamination with dirt and on the size of the dirty vessel. The dosing and the force of the explosion are selected such that no damage to the installation occurs. For example, the mixed gas quantity of acetylene and oxygen necessary for an effective cleaning lies between 5 and 30 litres per explosion. The optimum mixing ratio of the gases can be calculated from the stoichiometry of the gases and in the case of acetylene and oxygen it amounts to 1:3. In the case of an explosive gas mixture of oxygen and acetylene, the ratio is at 3.5:1 with a total gas volume of, for example, approx. 100 litres. The possibility of the optimum dosing of the components utilised on the one hand reduces the cleaning costs and on the other hand also reduces the hazard and damage risk for the installation and for human beings.

An in preference pipe-like device, such as a lance, is introduced into a vessel and brought into the proximity of the place to be cleaned. With this device, after the positioning of the device the component or the components can be introduced into the vessel. In the case of an on-line cleaning operation, the vessel to be cleaned and the flue gas may be up to 1000° C. hot. This signifies that, for the prevention of a premature explosion, the materials utilised for cleaning, e.g. gases and fuels, should be brought to the desired place more rapidly than they are capable of being heated up by, for example heat radiation. The pipe is preferably thermally insulated and/or cooled. This can be achieved by a pipe made out of thermally insulating materials such as a cooling system attached to the pipe or conducted through the pipe. The cooling for a pipe and/or for the materials utilised for the cleaning is preferably designed such that it is capable of functioning without a continuous supply of coolant from outside into the cleaning device or to the components or to the explosive mixture of gas, respectively. A pipe or a lance therefore would only have to be equipped with the connections for the, for example, gaseous components and correspondingly could be designed to be more simple. A cleaning device of this type is also not dependent on, e.g. water connections in the vicinity of the object to be cleaned. If for the cooling a coolant, such as, for example, water is utilised as insulation material for the lance, then for this purpose connections have to be attached to the lance. Any hoses required could, if so desired, be removed prior to the actual utilisation of the lance for the cleaning operation. If a cooling of the lance in a positioned condition by means of a flow of coolant is necessary, then this in preference is affected by conducting a coolant through the lance, so that it flows directly into the hot vessel. A cleaning device, however, may also be designed such a that a coolant flows back again inside the device.

In order to completely preclude the possibility of a premature explosion, the explosive, at least partially gaseous mixture is preferably only produced at the point in which the explosion is to take place. This is implemented, for example, by mixing a combustible gas and an oxidising agent in the vessel that is to be cleaned. It is, however, also possible to already bring together the individual components in a part of a supply line, e.g., inside the lance. As a result of this, thorough mixing of individual components is already started shortly before the place to be cleaned. With the necessary safety precautions, it is also possible to directly introduce an explosive gas or gas mixture into an installation or vessel. Also in the case of this variant, the hazard of a premature explosion of explosive materials or mixtures is minimal, because the introduction of a device and a possibly required positioning of it can be carried out beforehand and therefore completely without the presence of any explosive materials. If instead of gaseous materials one or more materials in liquid or powder form, e.g. fuels, are utilised, then these are conducted to the place to be cleaned through for example, the pipe-like device by means of a suitable pumping device, where the material or materials in liquid or powder form is/are Preferably nebulised or atomised. This can be implemented, for example, by pressure or gas atomisation, e.g. by using a gas utilised in the cleaning operation.

The dosing of gases, gas mixtures, possibly also of liquid materials, takes place preferably by means of pressure vessels. Beforehand, precisely dosed quantities of gas or liquid can be introduced into these pressure vessels, e.g. by means of controlled filling from commercially available gas cylinders. The utilisation of separate pressure vessels provides the benefit that the quantities and, with this, the fill pressures in these vessels are capable of being adapted to the desired force of the explosion in a very simple manner. In addition, by the introduction of the gases or liquids under pressure, the dwell time of the components in the hot ambient can be kept exceedingly short.

In order to prevent a dilution of gases, gas mixtures, materials in powder or liquid form, e.g. by the ambient air or flue gas, the materials are preferably held at or in the proximity of the place to be cleaned, for example, by means of a suitable thin-walled container. This is particularly advantageous in cases in which an explosive mixture is to be produced only in the proximity of the surface to be cleaned, for example, by a separate conducting of individual gases or fuels in a pipe-like device or a lance. A vessel of this kind prevents dilution of the gases, particularly prior to their complete mixing, and if so required also serves for cooling of the cases. Examples of suitable thin-walled containers are expanding, thin-walled, balloon-like containers, or flexible, elastic, thin-walled containers, such as, for example, sack-like envelopes or sacks. A thin-walled container is preferably attached to one end of a pipe, for example at the front end of the lance, and is inflated by the gases themselves. In order to prevent a premature explosion of the thin-walled container, it should be inflated more rapidly than it heats up as a result of convection or radiation and/or it should be cooled. Preferably, the thin-walled containers have a greater volume than the total volume of the components introduced into them. On the one hand, this prevents a premature destruction of the thin-walled container by bursting, e.g. of elastic, balloon-like container. On the other hand, for example, in the case of containers made out of non-expanding materials, such as, for example, sack-like plastic or paper envelopes, there is no overpressure in the container relative to the ambient. This prevents or minimises any outflow of gas in the case of permeable materials or in the case of a possible perforation of the thin-walled container, which could be caused, for example, by sparks or by sharp objects.

A front end cooling of the lance, i.e., cooling of the thin-walled containers is preferably implemented by means of passive cooling methods. In the case of a passive cooling of an explosive gas mixture, in the introduced condition of the cleaning device no additional cooling means are brought in from the outside to or into the explosive mixture. Apart from general constructional simplifications of the cleaning device this also has the advantage that supply lines for the materials required for the explosion can relatively easily be kept separate from a possible lance cooling system. In the case of a combination with a passive lance cooling system, the complete cleaning process can be kept essentially independent of a locally available infrastructure.

A thin-walled container, and therefore also the materials contained in it, is capable of being protected against undesirably high heating-up by means of a thermal insulating protective envelope or by means of a protective envelope already containing a coolant. An example for the latter kind of protective envelope can be designed in a very simple manner and, for example, would comprise a material as absorbent as possible, e.g. crepe or a sponge-like material, which prior to being introduced into the hot installation is soaked with coolant, in preference water. It is, however, also possible to manufacture the thin-walled container itself out of a material that absorbs or stores coolant.

It goes without saying that it is also possible to cool the thin-walled container by means of a suitable coolant, e.g. by spraying water, air or a mixture of both media onto the thin-walled container. Also possible is the injection of water droplets or of a different coolant into the thin-walled container during its inflation, so that its surface is cooled from the inside. This, for example, can be combined with the introduction of a liquid or gaseous component utilised for the cleaning operation.

A further preferred possibility of protecting the thin-walled container consists of introducing the thin-walled container into the vessel to be cleaned inside a suitable protective device. This is implemented, for example, by means of a protective device attached to the cleaning device, such as a protective bell or funnel attached to and around the lance. The thin-walled container can be stored in the protective device in an uninflated condition. The protective device is designed such that it provides the thin-walled container with the possibility of a substantially free expansion as soon as it is inflated. This can, for example, be realised by an opened protective device or by one that opens by a force or by pressure. An opening of the protective device arranged on the container side, i.e. the front end of the lance, may be equipped with a cover. A cover of this kind is preferable thin-walled, easy to open or release, so that it can be separated from the protective device by an expanding thin-walled container. A cover is preferably made out of materials that are capable of being soaked with coolant, such as, e.g., a piece of paper, jute, etc. Depending on the construction of the cover, the complete protective device may be enclosed by the cover. With this, a thin-walled container as well as a protective device are simultaneously protected and cooled.

In a preferred embodiment, an indirect, passive cooling system is utilised both for the thin-walled container as well as for the lance, this for the reasons already mentioned above. A passive cooling for an explosive mixture and a lance is independent of coolants actively brought in from the outside during the cleaning process itself, i.e., with the lance in the introduced condition. A passive lance cooling preferably takes place by the application of suitable materials around the pipe conducting gas and/or liquid, by manufacturing the pipe or the supply lines out of suitable materials. These, for example, are insulating, substantially heat-resistant materials or material arrangements and/or materials capable of absorbing coolants. Examples for the latter kind are absorbent materials, such as paper, cotton-wool or fabrics, which prior to being used are soaked in water or another coolant. For the protection against damage to a cooling layer, external protective layers may be affixed. In the case of absorbent paper, this could be a simple bandaging with fabric. It is, however, also possible to apply a more permanent protective layer made out of, for example, a metal screen or webbing or a second metal pipe. Materials absorbing coolants are capable of releasing them again when required and, as a result of the evaporation cooling produced, are capable of cooling the pipe or the thin-walled container. Passive cooling systems may also be, for example, dense metal webs or ceramics, which are capable of absorbing coolant in hollow spaces or pores. It is also conceivable to construct a passive cooling system out of heat absorbing materials. Materials of this kind are in a position to absorb heat and to store it instead of conducting it onwards. Examples for this are materials, which within a suitably chosen temperature range are subject to a phase change, typically solid to liquid (so-called "phase change materials" (PCM)). A further example for an insulating lance cooling system are double pipes, which may be filled with insulation material.

If so required, the most diverse cooling methods and protective devices may also be combined, made do without or complemented.

The ignition of the explosive gas mixture, i.e., liquid/gas mixture, with or without thin-walled container or protective envelope, takes place with means known from the prior art. Preferably, ignition is implemented by means of an electrically triggered spark ignition, by auxiliary flames, or by a pyrotechnic ignition with the help of correspondingly attached ignition means and ignition devices. The means of ignition are preferably attached in the region of one of the ends of the lance, to a pipe itself, or to the thin-walled container. The actuation of the ignition device as well as the sequence of an inflow of the gas and/or the introduction of liquid components preferably takes place by means of a control system.

The sequence of a blasting operation in a hot vessel in a preferred embodiment takes place as follows:

Gas-pressure vessels by means of the actuation of corresponding valves are filled with the corresponding gases, e.g. acetylene or ethane and oxygen and the required gas quantities and pressures out of pressure gas cylinders.

At one end of a pipe a thin-walled container (for example, made of plastic material, a balloon-like or sack-like envelope or a bag/sack) is attached, e.g. plugged on, clamped on or glued on with adhesive tape, and/or stowed in the protective device in folded condition.

If so required, a head cooling is activated, e.g., a protective envelope (insulating and/or cooling) attached, soaked with coolant, and/or the cooling started together with the gas.

The lance is introduced into the vessel to be cleaned from the outside, such as through an access opening, so that the end of the pipe including the thin-walled container is placed in front of the surface to be cleaned.

The opening of the valves of the gas pressure vessels starts the filling of the thin-walled container with the gas mixture.

The ignition device is actuated and an explosion triggered.

Individual steps of the sequence mentioned above of a blast cleaning process in accordance with the invention may also be supplemented and/or automated with intermediate steps. For example, the triggering of an explosion process may be connected with safety mechanisms. Such safety mechanisms preferably start the gas supply from the pressure vessels to the thin-walled containers, or in general into the vessel to be cleaned, and interrupt this connection before the actual explosion takes place, e.g., by means of an activation of the means of ignition. This arrangement prevents, for example, blowbacks into the supply lines and uncontrolled detonations. In addition, the cleaning process may also include a device cleaning step. This is implemented, for example, by means of a blowing-through with compressed air of the lance of individual pipes following the explosion.

BRIEF DESCRIPTION OF THE DRAWINGS

In the following, embodiments of the device for the cleaning method for caked and slag contaminated vessels according to the invention are explained in more detail on the basis of exemplary and schematically drawn figures, wherein.

DETAILED DESCRIPTION OF THE PREFERRED EMBODIMENTS

Figure 1:
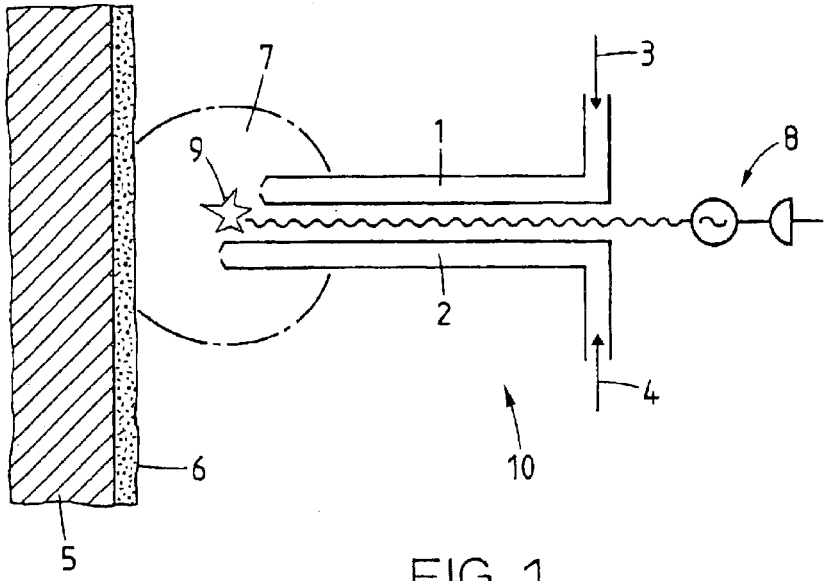
FIG. 1 is a simplified depiction of an embodiment of the device in accordance with the invention.

In FIG. 1, a device 10 for carrying-out the cleaning process according to the invention is illustrated. The device 10 includes pipe-like supply lines 1, 2 through which, preferably after their positioning, different gases, such as oxygen 3 and ethane 4, but also liquid fuels or oxidising agents are conducted to the proximity of the wall 5 to be cleaned. The gases 3, 4 and/or liquids in the zone of the wall contaminated with dirt 6 form an explosive mixture 7. By means of an ignition device 8, which is capable of being controlled and actuated from outside the vessel or installation to be cleaned, the explosive mixture 7 is ignited, for example, by the generation of an ignition spark 9. An ignition device located in the zone of the gas mixture 7, for example, on the supply lines 1, 2, may also trigger the explosion. The supply lines 1, 2 and the ignition device 8, here are designed such that the ignition spark 9 does not come to be situated directly in front of the end of a supply line 1, 2, in order to prevent a blowback of the cleaning device 10 (a backfire into the supply lines 1,2). This can be implemented, in that the ignition spark 9 comes to be situated in the zone between the ends of supply lines 1, 2 of differing lengths.

The connection for the gas supply 23 is affixed to the inner pipe 22 and connects two gas supply lines 29, 30 with the lance 20. One of the gas supply lines 30 is connected with a first pressure vessel 34 through a solenoid valve 32, wherein this vessel itself is connected with a commercially available first gas cylinder 36 through a fourth valve 38, e.g., an oxygen cylinder. The second gas supply line 29 in essence is constructed in the same manner, i.e. it is connected with a second pressure vessel 33 through a second solenoid valve 31. This vessel, in turn, is connected with a second commercially available gas cylinder 35 through a third valve 37. The second gas cylinder 35 correspondingly contains a combustible gas, such as, for example, acetylene, ethylene or ethane.

In case of a thin-walled container possibly present on the device 10 for the protection of the gases against dilution, a head cooling system for the lance is preferably constructed as a protective envelope soaked with coolant. The head cooling system may also be designed as a coolant supply conducted right into the container. In this manner, the thin-walled container and the gas or gas/liquid mixture contained therein are cooled. The materials utilised for the supply lines 1, 2 and/or for a common pipe also preferably possess thermal insulation characteristics in order to protect the gas 3, 4 or the liquid contained therein against external thermal influences by, for example, flue gas.

Figure 2:
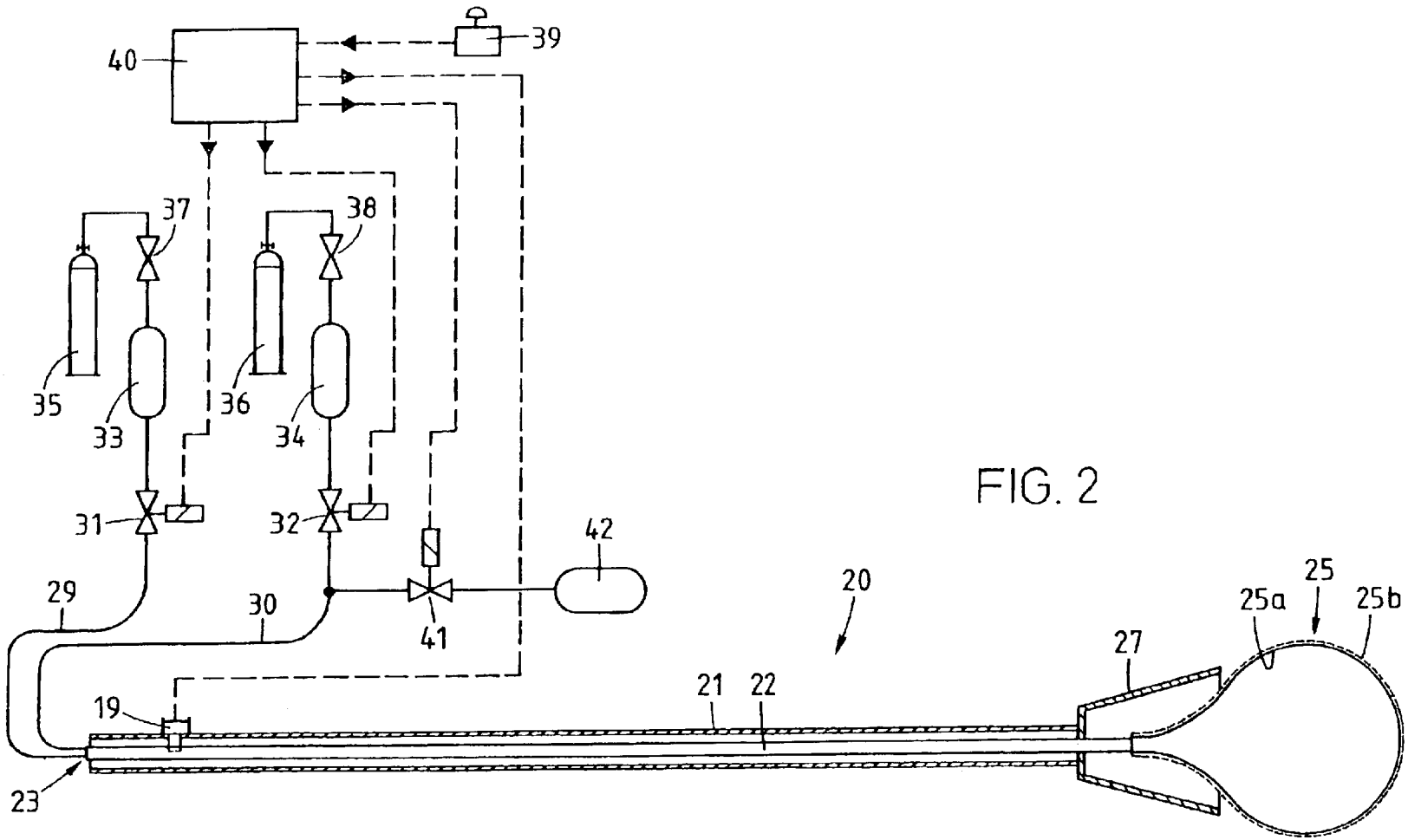
FIG. 2 is a further embodiment of the device according to the invention, and, FIG. 3 is a third embodiment of the device in accordance with the invention.

In FIG. 2 a further exemplary device for the implementation of the cleaning process in accordance with the invention is illustrated. A coolable, insulated lance 20, which has an envelope 21 and an inner pipe 22 at one of its ends, comprises connections 23 for the gas supply. Also situated in the zone of this end of the lance 20 is a suitable means of ignition, such as a spark plug 19, with which an explosive gas mixture is capable of being ignited, in preference electrically. The envelope 21 protects the lance 20 and the gas or gas mixture present inside it against being heated up. The envelope 21 preferably comprises absorbent material, such as paper, and may also be equipped with a protective layer surrounding the absorbent material The protective layer may be, for example, an absorbent fabric or a heat-reflecting foil-like envelope, preferably equipped with openings. A possible protective layer, not illustrated in more detail here, substantially serves to prevent or to reduce the peeling-off or damaging of the material of the envelope 21 serving as an absorbent or storage device for the coolant by external mechanical influences. A protective layer may also be equipped with additional absorbent or insulating characteristics.

Attached to the other end of the lance 20 is a thin-walled container 25, here already inflated, and a protective bell 27. The thin-walled container 25 is attached to the inner pipe 22 such that it is inflated by the gas or gas mixture flowing through the inner pipe. The thin-walled container comprises a substantially gas-tight plastic envelope 25*a*, for example a plastic sack made out of polyethylene and a protective envelope 25*b* surrounding the plastic envelope 25*a*. The protective envelope 25*b* preferably is an envelope made out of absorbent paper, which is connected, such as by gluing, with the plastic envelope 25*a*. Prior to the utilisation of the lance 20, i.e. prior to the introduction of the lance 20 into an installation to be cleaned, the paper envelope and the sheathing 21 of the lance 20 are covered with coolant, i.e., soaked with water. The thin-walled container 25 is stowed in the protective bell 27 in a folded condition. Preferably, on top of the protective bell there is an additional cover soaked with coolant (not illustrated in detail) in order to additionally cool the thin-walled container inside and, if necessary, to protect it from mechanical influences. Following the introduction and positioning of the lance in the vessel to be cleaned, the thin-walled container 25, upon inflation, leaves the protective bell 27. In doing so, the container is protected from the heat of the flue gases by the water-soaked paper envelope and the inner pipe 22 by the sheathing 21. The protective bell 27 has a slightly conical shape opening outwards like a beaker in order to give the inflated envelope or the balloon-like container sufficient space. A protective device, for example, has the shape of a hollow cone or hollow cylinder or else of a bowl. Preferably, the protective device comprises an opening located on one side for the passage of the supply line or lines and on the other side an opening for a thin-walled container. A protective device may also be constructed with double walls, so that a possible internal space is filled or is able to be filled with insulating material or coolant. The protective bell 27, the sheathing 21 or another protective device are permanently attached to the lance. They may, however, also be constructed such that they can be slid over the lance or laid around it and positioned in different ways. This makes possible an easy replacement of a protective device following a cleaning process. For technical and economical considerations, however, for protective devices if at all possible heat-resistant materials are utilised.

The connection for the gas supply 23 is affixed to the inner pipe 22 and connects two gas supply lines 29, 30 with the lance 20. One of the gas supply lines 30 is connected with a first pressure vessel 34 through a solenoid valve 32, wherein this vessel itself is connected with a commercially available first gas cylinder 36 through a fourth valve 38, e.g., an oxygen cylinder. The second gas supply line 29 in essence is constructed in the same manner, i.e. it is connected with a second pressure vessel 33 through a second solenoid valve 33. This vessel, in turn, is connected with a second commercially available gas cylinder 35 through a third valve 37. The second gas cylinder 35 correspondingly contains a combustible gas, such as, for example, acetylene, ethylene or ethane.

After opening the third and fourth valves 37, 38, the pressure vessels 33, 34 are filled with the corresponding gases. A fill pressure already proved by trials lies at max. 15 bar, wherein the pressure vessel volumes, for example, have values of 1.5 liters for ethane and 5 liters for oxygen and typically an overall gas volume of 100 to 200 liters is utilised for the cleaning of customary vessels. The ratio of the volumes of both the pressure vessels in preference corresponds to the stoichiometric ratio of the two gases for a complete combustion. The pressures of the gases in the pressure vessels determine the power of the explosion and can be adjusted through reducing valves on the gas cylinders 35, 36. These pressures are preferably the same.

By means of an external pressure switch 39 connected with the spark plug 19 on the lance 20, the detonation process is started. The sequence preferably is controlled with a control system 40, e.g. a relay control system. The control paths are indicated in the Figure as dashed lines, wherein the signal direction is indicated with arrows. First of all, the solenoid valves are briefly opened, e.g. for a few seconds. During this time period the gas content of the pressure vessels 33, 34 flows into the lance 20 through separate gas supply lines 29, 30. There the components are mixed and conducted into the thin-walled container 25 through the inner pipe 22, wherein they inflate the thin-walled container. In a preferred embodiment of the cleaning device, the gas supply lines 29, 30 are maintained separate in the inner pipe 22 of the lance so that the gases are only mixed inside the thin-walled container 25 and there form an explosive gas mixture.

After the closing of the solenoid valves 31, 32, in preference after a selected time delay of, for example 0.5 sec, the ignition device is actuated and the explosion is triggered. Depending on the selected construction of the gas supply, the spark plug 19 or the ignition device is correspondingly positioned on the lance. The inflation process of the thin-walled container 25 amounts to a few seconds, typically 1–3 sec, e.g., 2 sec.

Following the ignition of the gas mixture, the inner pipe is preferably cleaned of the residues of the explosion, e.g. slag. This takes place, for example, by means of compressed air, which is sent through the inner pipe 22. For this purpose, one of the gas supply lines 30 is equipped with an additional valve 41, which is connected with a compressed air reservoir 42 such as a compressed air compressor or a compressed air cylinder. This additional valve 41, here depicted as a solenoid valve, preferably is also capable of being driven and actuated automatically.

If for the cleaning not only gaseous, but also, exclusively liquid materials are utilised, then the volume of the thin-walled container 25 may be kept correspondingly small. It is then made out of a correspondingly suitable material, for example out of a substantially liquid-tight plastic envelope.

Figure 3:
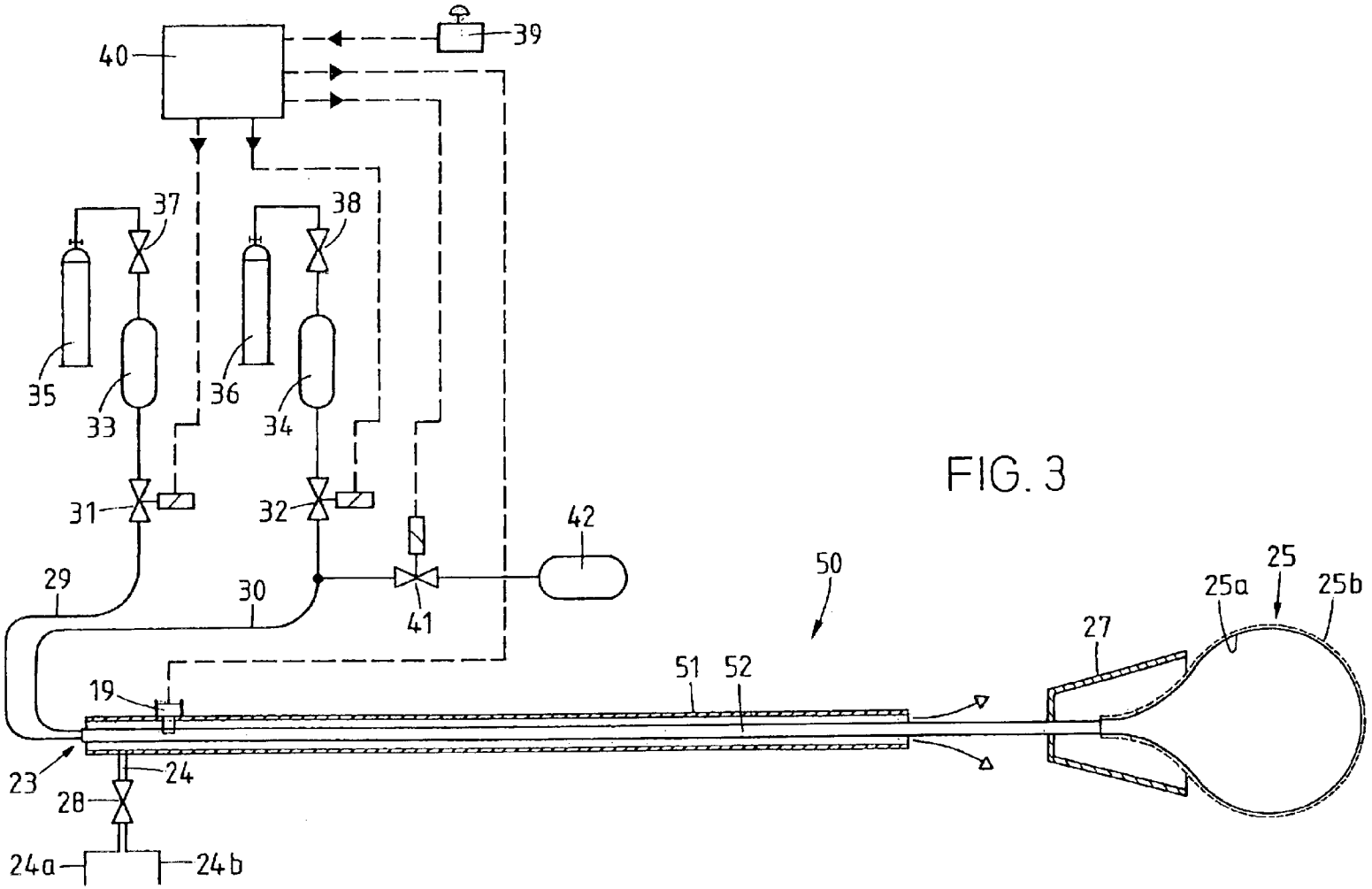

FIG. 3 illustrates a third embodiment of the device in accordance with the invention. The third embodiment illustrates an exemplary construction of a coolable lance 50. A majority of the reference marks are the same as in FIG. 2. These correspondingly refer to the same exemplary characteristics and elements and not all of them are mentioned anymore at this point. The coolable lance 50 comprising an outer pipe 51 and an inner pipe 52, at its end is equipped with connections 23, 24 for the gas supply and for a coolant. A coolant, for example an air-water mixture, is conducted between the outer pipe 51 -and inner pipe 52. The coolant exits at a second end of the lance 50, which is indicated by arrows. A protective bell 27 for the thin-walled container 25 is attached at the second end of the lance 50. Depending on the flow speed or the distance of the coolant outlet opening of the lance 50 from the protective bell 27, the coolant conducted through the lance 50 is also able to cool the protective bell 27.

The connection 24 of the cooling system is equipped with a cooling connection valve 28, for example a manually operated valve. Actuating the valve switching the cooling system on and off, as required. Preferably, the production of a certain mixing ratio of differing coolants is made possible, here represented by two connection lines or -hoses 24*a*, 24*b*, respectively.

A lance cooling system designed in this manner is preferably activated prior to the introduction of the lance 50 into a hot vessel. Typically the cooling system remains switched on for the whole time period, during which the lance is subjected to the heat. An active lance cooling system of this kind is also capable of being included in a control system 40. Naturally it is also possible to introduce a coolant through a coolant connection at one end of the lance 50 and to have it flow back again to the same end. This would be possible, for example, in the case of an outer pipe 51 closed at one end with a substantially U-shaped or concentric coolant supply system.

The cleaning method according to the invention with the device described in FIG. 3 proceeds in a similar manner as that of FIG. 2: Soaking of a thin-walled container 25 with coolant, activation of the lance cooling system, introduction and positioning of the lance, filling of the pressure vessels 33, 34 with the required gas quantities, and triggering of the ignition process by means of actuating a pressure switch 39. The gas or gases flow through the lance 50 and inflate the thin-walled container 25. This container is initially protected against heating up by the protective bell 27, and thereafter by the soaked protective envelope 25*b*. When the required gas volume has reached the thin-walled container 25, the explosive gas mixture is ignited by the ignition means 19. Preferably, following the cleaning process the inner pipe 52 and possibly also the outer pipe 51 is cleaned in a cleaning step, for example by means of compressed air, wherein the pipe(s) are freed of slag and water.

The utilisation of a thin-walled container in accordance with the invention presented here provides the advantage that it is exceedingly cheap to manufacture. An additional advantage of a thin-walled container made of a plastic sack enveloped with paper is the fact that, while any possible sparking can perforate the plastic sack, the envelope, however, continues to protect the explosive gas or -gas mixture. A protective envelope made of absorbent material may be constructed with several layers. By means of the, for example, provision of several single-layer protective envelopes, the container therefore is capable of being adapted to temperatures in differently hot vessels. By exploiting the evaporation cooling of suitable coolants, no supply of coolant into or through the lance is necessary during the actual cleaning process.

What is claimed is:

1. A method for cleaning deposits from surfaces in a vessel when the vessel is hot during operation of an installation, comprising the steps of: introducing a lance (20)

into the vessel and placing the lance (20) in the vessel such that a mouth of the lance (20) is positioned in proximity to the deposits (6), then guiding through the lance (20) a flowable, explosive mixture (7), or flowable components which components, when mixed, form an explosive mixture, and thereby placing said flowable mixture or flowable components in proximity to the deposits (6), and detonating the explosive flowable mixture (7), which is, when appropriate, produced by mixing of the flowable components, to clean the deposits (6) from the vessel.

2. The method for cleaning deposits according to claim 1, wherein the explosive, flowable mixture or the flowable components are at least partly in a form selected from the group consisting of gaseous, liquid and powdery.

3. The method for cleaning of deposits according to claim 1, comprising the further steps of attaching a thin-walled container (25) to the lance (20) and placing the thin-walled container (25) in proximity to the deposits (6), and wherein the flowable explosive mixture (7) or the flowable components which components, when mixed, form an explosive mixture, is/are introduced into the thin-walled container (35) and detonated therein, whereby the thin-walled container is destroyed.

4. The method for cleaning deposits according to claim 3, wherein, prior to detonation, the thin-walled container (25) is inflated by gases (3, 4) or by the explosive flowable mixture (7).

5. The method for cleaning of deposits according to claim 3, wherein the flowable, explosive mixture (7) is mixed in the thin-walled container (25) while said thin-walled container is in proximity to the surface to be cleaned (5) of said deposits.

6. The method for cleaning deposits according to claim 3, wherein said thin-walled container (25) is an inflatable envelope, said inflatable envelope being a flexible plastic envelope (25*a*) or an elastic, balloon-like container.

7. The method for cleaning deposits according to claim 3, including the further step of cooling at least one of said lance (20) and the thin-walled container (25).

8. The method for cleaning deposits according to claim 7, wherein the thin-walled container (25) is cooled by a protective envelope (25*b*) soaked with coolant.

9. The method for cleaning deposits according to claim 1, wherein gases (3, 4) or the explosive, flowable mixture (7) flow out of at least one pressure vessel (33, 34) into the lance (20).

10. The method for cleaning deposits according to claim 1, wherein the flowable explosive mixture (7) is produced by mixing of a gaseous fuel (4) and a gaseous oxidising agent (3).

11. A device for cleaning of deposits from vessels, comprising a lance and supply means (1,2) disposed on one end of the lance, wherein the supply means is adapted to conduct into the lance a flowable explosive mixture (7) or flowable components, which components, when mixed, form an explosive mixture, and wherein the other end of the lance is introduced into the vessel and includes an expandable thin-walled container (25), wherein said thin-walled container is arranged to receive the flowable explosive mixture or the flowable components, respectively.

12. The device according to claim 11, wherein said supply means is adapted to conduct the flowable components separately through the lance.

13. The device according to claim 11, further comprising ignition means (8) for igniting the explosive mixture (7) or the components forming an explosive mixture (7).

14. The device according to claim 11, further comprising means for cooling at least one of the lance and the thin-walled container.

15. The device according to claim 11, further comprising a head cooling system, said head cooling system including a protective envelope (25*b*) soakable with coolant.

16. The device according to claim 11, wherein the end of lance leading into the vessel comprises a protective device (27), in which the uninflated thin-walled container (25) is stowed away.

17. The device according to claim 11, wherein the thin-walled container is substantially gas-tight or liquid-tight.

18. The device according to claim 17, wherein the thin-walled container (25) is selected from the group consisting of a flexible plastic envelope (25*a*) and an elastic, balloon-like container.

* * * * *